US006490986B1

(12) United States Patent
Sherdel

(10) Patent No.: US 6,490,986 B1
(45) Date of Patent: Dec. 10, 2002

(54) BILGE PUMP INTERFACE HOUSING AND METHOD OF FACILITATING OPERATION AND REPLACEMENT OF A BILGE PUMP AND FLOAT SWITCH

(76) Inventor: Jack Sherdel, 381 Creekstone Ct., Longwood, FL (US) 32779

( * ) Notice: Subject to any disclaimer, the term of this patent is extended or adjusted under 35 U.S.C. 154(b) by 0 days.

(21) Appl. No.: 10/036,311

(22) Filed: Dec. 26, 2001

(51) Int. Cl.[7] ..... B63F 4/00
(52) U.S. Cl. ..... 114/183 R; 220/3.2; 220/3.8
(58) Field of Search ..... 114/183 R; 174/50, 174/50.51, 50.52, 50.61; 220/3.2, 3.3, 3.8

(56) References Cited

U.S. PATENT DOCUMENTS

| | | | | | |
|---|---|---|---|---|---|
| 2,452,494 | A | * | 10/1948 | Rothen | 174/59 |
| 3,564,486 | A | * | 2/1971 | Price | 174/59 |
| 4,395,605 | A | | 7/1983 | Weston | 200/84 |
| 4,399,338 | A | | 8/1983 | Jones | 200/84 |
| 4,468,546 | A | | 8/1984 | Jones | 200/84 |
| 4,540,342 | A | | 9/1985 | Steiner et al. | 417/40 |
| 4,623,452 | A | | 11/1986 | Petersen | 210/104 |
| 4,623,753 | A | * | 11/1986 | Feldman et al. | 174/50 |
| 4,678,403 | A | | 7/1987 | Rudy et al. | 417/12 |
| 4,778,957 | A | | 10/1988 | Crowell | 200/84 |
| 4,789,367 | A | | 12/1988 | Fulks | 440/88 |
| 5,076,763 | A | | 12/1991 | Anastos et al. | 417/44 |
| 5,324,170 | A | | 6/1994 | Anastos et al. | 417/12 |
| 5,404,048 | A | | 4/1995 | Panner | 307/118 |
| 5,467,643 | A | | 11/1995 | Barnett et al. | 73/116 |
| 5,545,012 | A | | 8/1996 | Anastos et al. | 417/44.11 |
| 5,622,477 | A | * | 4/1997 | Orth et al. | 417/40 |
| 5,814,780 | A | | 9/1998 | Batchelder et al. | 200/84 |
| 6,119,638 | A | | 9/2000 | Kennedy | 123/41.47 |
| 6,276,908 | B1 | | 8/2001 | Batchelder et al. | 417/423.14 |

* cited by examiner

*Primary Examiner*—Sherman Basinger
(74) *Attorney, Agent, or Firm*—Allen, Dyer, Doppelt, Milbrath & Gilchrist, P.A.

(57) ABSTRACT

A method and interface housing facilitates operation and replacement of a bilge pump and float switch located in the bilge of a boat and powered by a boat power source and having a manual and automatic mode of operation. Power source, bilge pump and float switch wires located between the boat power source, bilge pump and float switch are cut. The bilge pump and float switch are replaced. Power source wires are routed into the interface housing and connected to separate manual, automatic and common wire connectors mounted therein. Bilge pump and float switch wires are routed into the interface housing and connected to separate pump and float switch wire connectors mounted therein. The interface housing is sealed in a watertight seal.

14 Claims, 5 Drawing Sheets

BILGE PUMP INTERFACE HOUSING AND METHOD OF FACILITATING OPERATION AND REPLACEMENT OF A BILGE PUMP AND FLOAT SWITCH

FIELD OF THE INVENTION

This invention relates to the field of bilge pumps, and more particularly, this invention relates to a bilge pump and float switch used in a boat where the float switch is responsive to a rise in fluid level in the bilge to operate the bilge pump.

BACKGROUND OF THE INVENTION

A bilge pump and its associated float switch are extremely important to boats of all sizes from a small inboard/outboard ski boat to a large boat such as an ocean-going yacht greater than 50 or 60 feet in length. Failure of a bilge pump could create excessive flooding, exacerbating existing problems. In a worse case scenario, the flooding would actually sink the boat. Typically, the bilge pump is associated with a mercury style float switch that is operative when the water level rises and triggers the float switch to turn on the bilge pump and initiate pumping of water from the boat or yacht.

As is typical in most boats using a bilge pump and float switch, an operator switch is located adjacent the steering column and includes a three position switch for automatic, manual, and off positions. As shown in FIG. 1, the automatic is an "always hot" connection that allows power to the float switch such that the bilge pump will automatically operate in the on position when water causes the mercury float switch or other similar float switch to engage into the on position by the rising water. The operator switch located at the steering column can be switched into a manual position to bypass the float switch and allow power through a manual wire to the bilge pump. An off position would turn the bilge pump off by preventing any power to the bilge pump. When the bilge pump is operational, typically a small red light, such as contained in the three-position operator switch, is lit to indicate bilge pump operation.

Many different types of bilge pumps and associated float switches are available in the commercial marketplace. An example of different types of bilge pumps, float switches and associated pump control apparatus are disclosed in U.S. Pat. Nos. 4,778,957; 5,076,763; 5,324,170; 5,404,048; 5,545,012; 5,814,780; and 6,276,908, the disclosures which are hereby incorporated by reference in their entirety.

Sometimes, after prolonged flooding in a bilge, the bilge pump and its associated float switch are inoperable. It has been found that after severe flooding, the bilge pump and float switch were both operable, but the wiring between the bilge pump and float switch such as the house grade wiring had corroded enough to create a poor electrical connection. Current could not pass to the bilge pump and activate the bilge pump motor. Often, in this type of situation, the owner or boat repair yard will replace all components as insurance against any future disasters, spending excess time and money when it is not necessary. Owners and boatyards argue that this approach is necessary because the bilge pump system is crucial to the safety of the vessel and its occupants. Because of the increased expense and involvement of replacing a bilge pump and float switch, many owners of vessels are reluctant to perform scheduled replacements of these components, and only take reactive measures when a disaster, such as flooding, occurs.

SUMMARY OF THE INVENTION

It is therefore an object of the present invention to facilitate replacement of a bilge pump and float switch that overcomes the problems as identified above.

The present invention facilitates operation and replacement of a bilge pump and float switch located in the bilge of a boat (i.e., vessel) as typically defined by a bilge bulkhead and powered by a "power source" and having a manual and automatic mode of operation. The power source, bilge pump and float switch wires that are located between the boat power source, bilge pump and float switch are first cut. The bilge pump and float switch are replaced. The power source wires are routed into an interface housing and connected to separate manual, automatic and common wire connectors mounted therein. Bilge pump and float switch wires are also routed into the interface housing. The bilge pump and float switch wires are connected to separate pump and float switch wire connectors mounted therein.

In one aspect of the present invention, a separate pump wire connector and float switch wire connector are associated with a single manual wire connector. A single automatic wire connector is associated with a single float switch wire connector. A single common wire connector is associated with a single pump wire connector. The interface housing is sealed in a watertight seal after connecting the various wires to various wire connectors. The separate manual, automatic and common wire connectors are preferably spaced in opposed relation to the respective pump and float switch wire connectors to facilitate connection of the respective wires.

The wire connectors are preferably formed as screw-down type wire connectors to facilitate insertion of a wire and connection thereto. The power source wires can be routed through at least one access opening formed as an access port on one side of the interface housing and the bilge pump and float switch wires can be routed through at least one opposed access opening or port on the other side of the interface housing. The interface housing can be formed to have a top access opening through which wires can be manually manipulated into various wire connectors and onto which an access cover is positioned to form a watertight interface housing.

The at least one wire access port is sealed with a watertight seal and the access cover replaced over the access opening in a watertight seal. The operation of the bilge pump and associated float switch are tested.

An interface housing is also used to facilitate operation and replacement of a bilge pump and float switch located in the bilge of a boat as defined by the bilge bulkhead and powered by a boat power source. The system has a manual and automatic mode of operation. The interface housing includes a substantially rectangular configured box structure having a wire mounting board positioned therein on which manual, automatic and common wire connectors and respective pump and float switch wire connectors are mounted in opposing relation to each other. A top access opening allows manual access to the wire connectors and wire is routed therein. An access cover closes the access opening to form a watertight seal for the interface housing once the various wires are connected to various wire connectors.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The present invention advantageously provides a method and interface housing that facilitates operation and replacement of a bilge pump and float switch located in the bilge of a boat as defined by a bilge bulkhead and powered by a boat power source and having a manual and automatic mode of operation. The method and interface housing of the present invention offer an advantage over prior art procedures for replacing the bilge pump and float switch by allowing a circuit interface for greater control and facilitating repeated replacements of the bilge pump and float switch.

Figure 1:
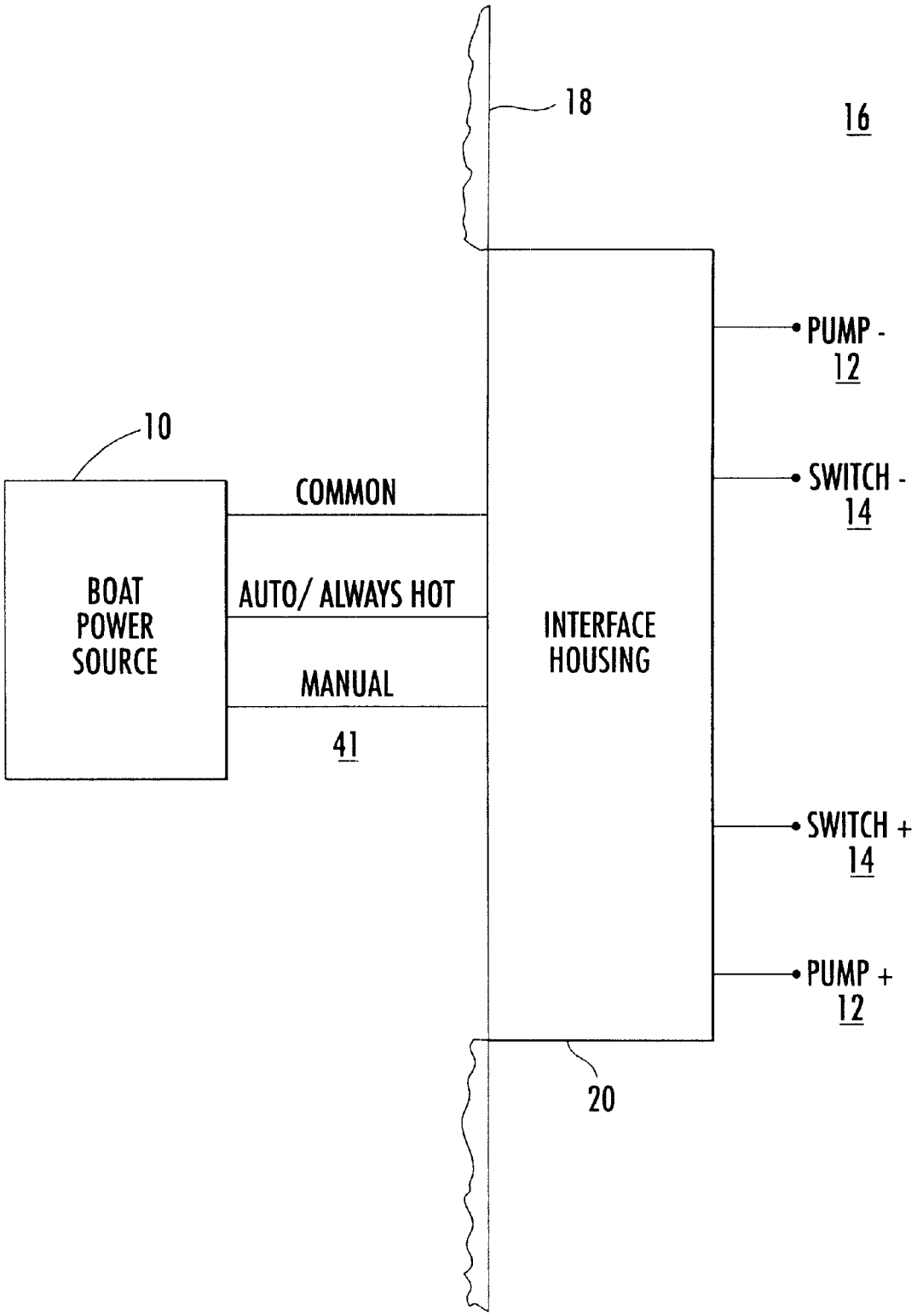
FIG. 1 is a high level block diagram of a circuit structure of a bilge pump and float switch connected to a beat power source.

FIG. 1 illustrates a basic block level circuit diagram showing a boat power source 10 connected to a bilge pump 12 and float switch 14 of the type as known to those skilled in the art, such as commonly manufactured and sold by Rule Industries, Inc. Typically the float switch 14 is a mercury type float switch, but other types of float switches are often used as known to those skilled in the art. The bilge pump 12 and float switch are mounted in the bilge 16, which includes a bilge bulkhead 18, for example. The interface housing 20 of the present invention allows the interface of different wires from the power source 10 to the bilge pump and float switch. The interface allows connection of wires from the typical three-way switch having a manual, automatic, and off mode of operation, as known to those skilled in the art. The power source wires include a common wire and manual wire, i.e., wire for power during manual operation when the switch is placed to manual and the float switch bypassed. The automatic wire is "always hot" to allow automatic operation of the bilge pump when rising water activates the float switch.

The prior art techniques for replacing a bilge pump and its associated float switch were cumbersome such that boat owners were less prone to replace a bilge pump and float switch on a periodic basis. Often replacement of these components occurred only when the bilge pump and/or float switch failed and the bilge had flooded, mandating maintenance and replacement.

In a prior art procedure, the wire or wires are first cut between the power source, the bilge pump and the float switch. The boat wire is typically no. 6 wire size and the bilge pump and float switch are no. 10 wire size. These are not absolute wire size values, and wire sizes vary, but they are typical wire sizes used in marine applications. The bilge pump and float switch are then removed. The no. 6 wire size for the boat is stripped. In some instances, previous replacements of the bilge pump and float switch had required that the wire harness be shortened to three inches in some existing boat designs, as known to those skilled in the art. A new bilge pump and float switch are replaced into existing mounts.

The no. 6 manual wire is reconnected to the no. 10 bilge pump positive wire and the no. 10 float switch wire after all wires had been stripped. This can be accomplished in a number of ways, such as by using a solderless connector. The use of this type of connector can pose a problem because the no. 6 wire connector required for the power source wire from the boat is too large for the no. 10 wire used for the float switch and the no. 10 wire used for the bilge pump. There is too much slack when the two no. 10 wires are inserted into the remaining half of the no. 6 wire connector. This creates an unreliable connection. Other common connections include twisting a no. 6 and the two no. 10 wires together and electrically taping them with insulation. It is also possible to use a terminal strip type system. These connection systems are all subject to poor initial electrical contact and exposure to the harsh bilge environment, causing corrosion of the wire and other metallic components of the power/bilge pump and float switch connection assembly.

After the wires are reconnected, the no. 6 wire from the boat automatic service is connected to the no. 10 switch wire. The no. 6 wire from the boat ground is connected to the bilge pump common no. 10 wire. Other problems as noted above also exist for these wire connections.

Figure 2:
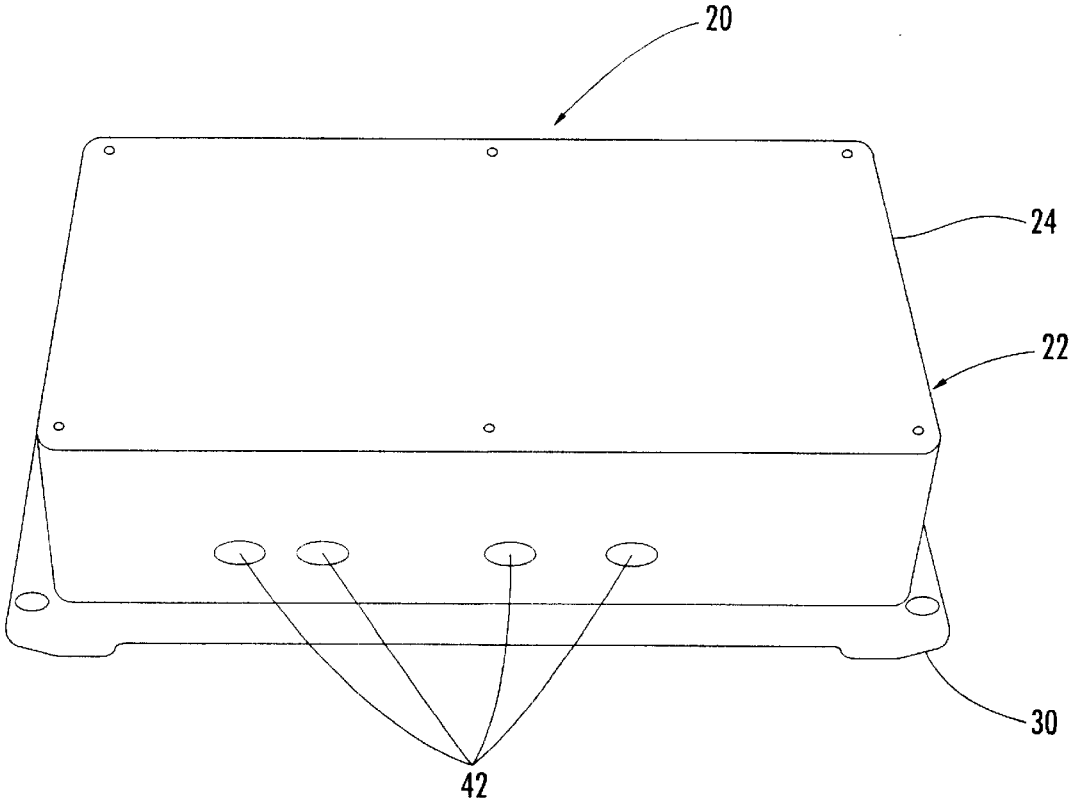
FIG. 2 is an isometric view of an interface housing of the present invention.
Figure 3:
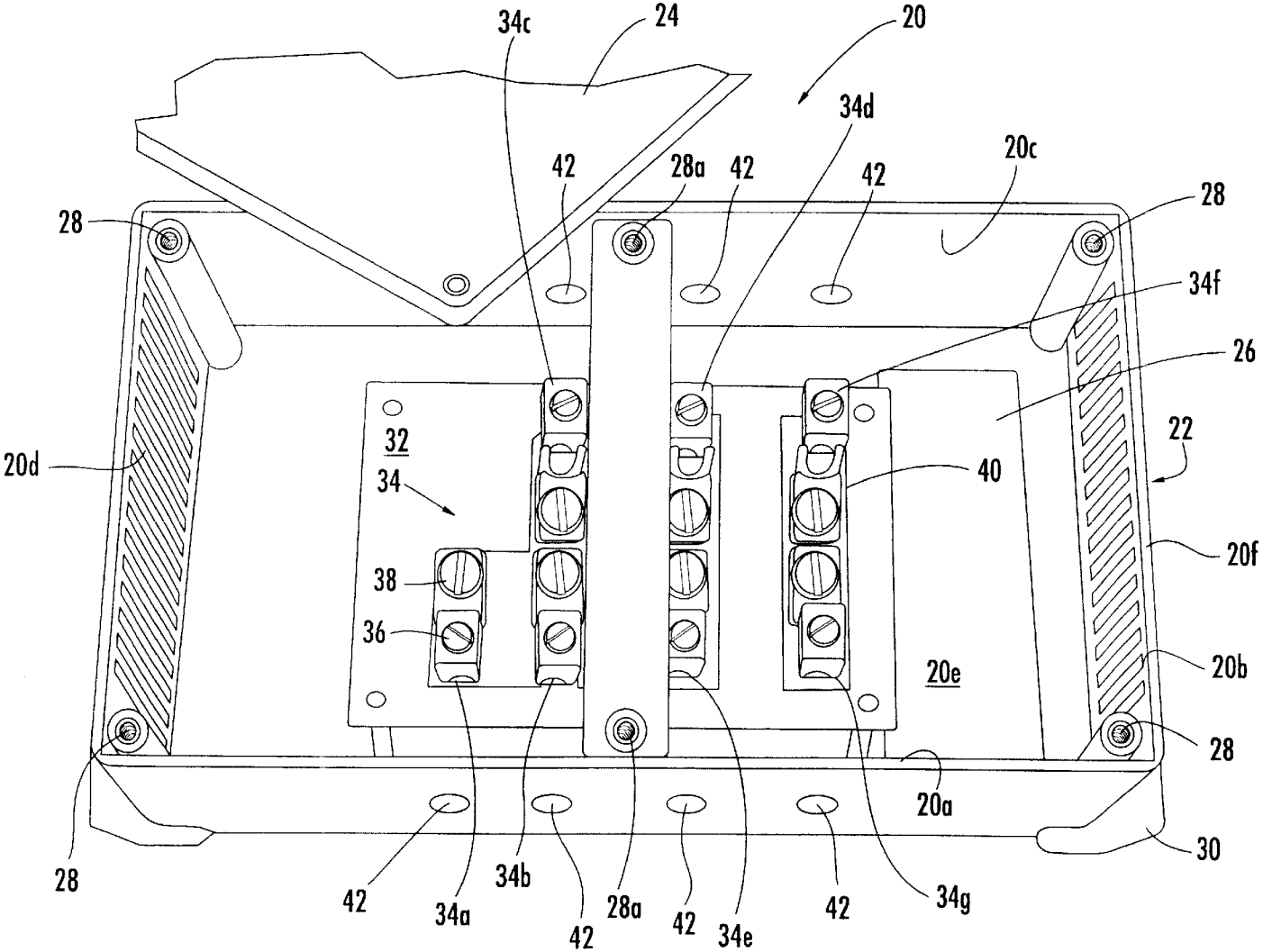
FIG. 3 is another isometric view of the interface housing of FIG. 2 showing the top cover removed and showing the various manual, automatic, wire, pump, and float switch wire connectors mounted therein.
Figure 4:
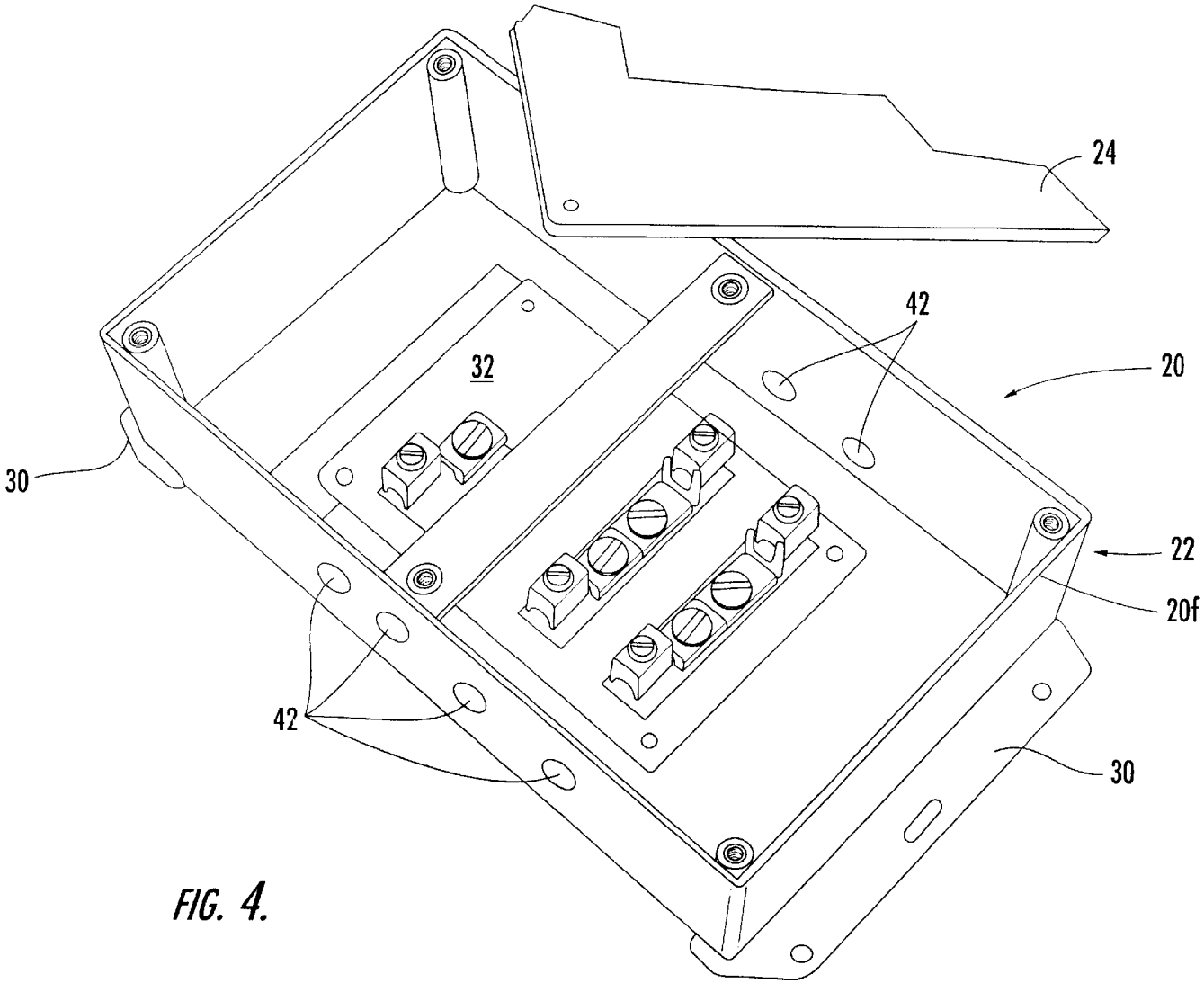
FIG. 4 is another isometric view similar to FIG. 3 and showing the interface housing with the top cover removed.
Figure 5:
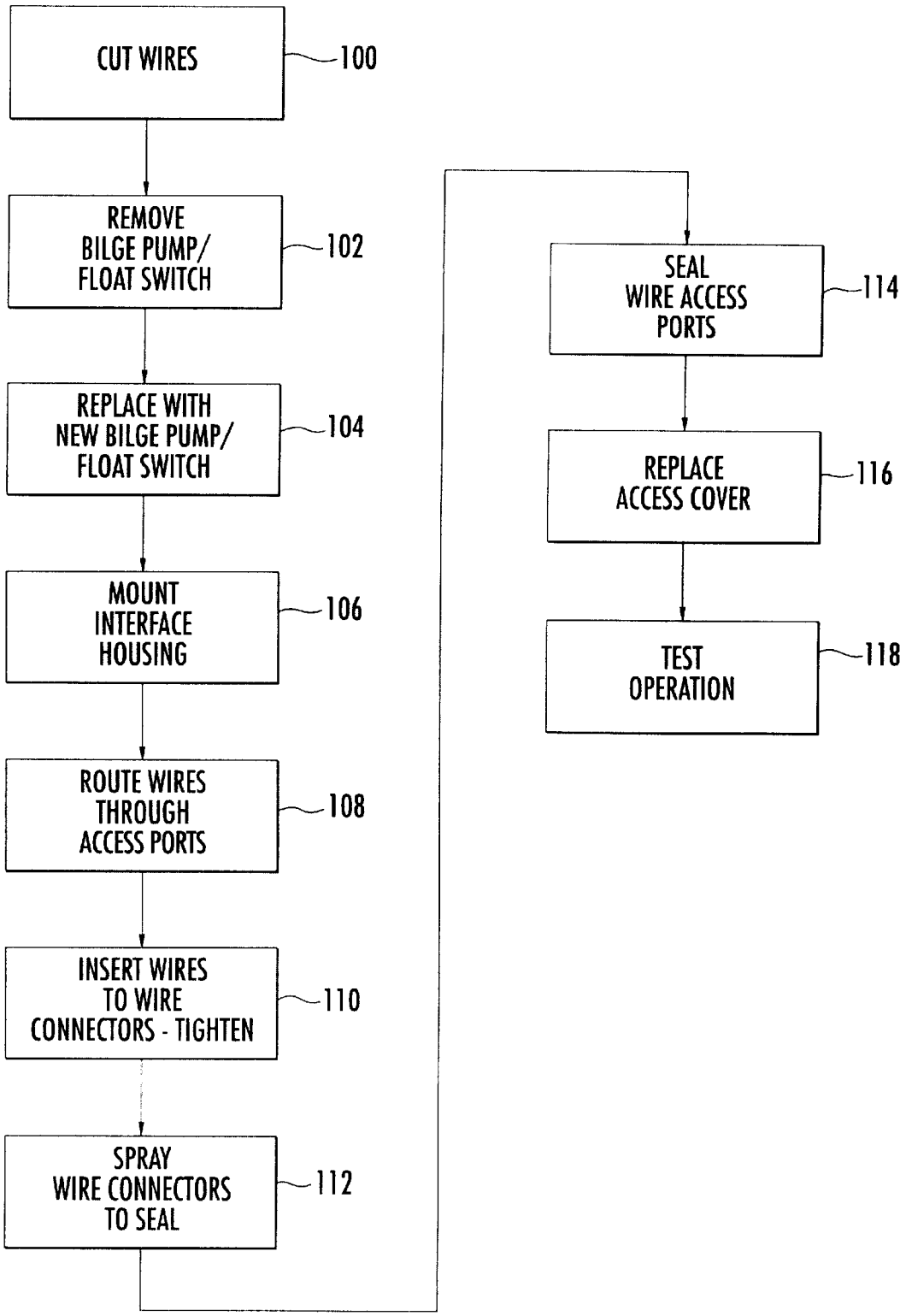
FIG. 5 is a high level flow chart showing the basic method of the present invention for facilitating operation and replacement of a bilge pump and float switch located in the bilge of a boat.

The use of the interface housing 20 as shown in FIGS. 2–4 and the method of the present invention described in the flow chart of FIG. 5 advantageously overcomes the drawbacks of the prior art replacement method as described above. The following description will proceed with the description of the interface housing 20 followed by a description of the various steps used in the method of the present invention.

As shown in FIGS. 2–4, the interface housing 20 includes a substantially rectangular configured box structure 22 formed from a rigid plastic material or other rigid, waterproof material known to those skilled in the art. The interface housing is rectangular configured and includes four sides 20*a–d*, a bottom surface 20*e* and a top access cover 24 that is positioned over an access opening 26 in a watertight seal as shown in FIG. 2. Four screw holes 28 are positioned at each corner and two screw holes 28*a* are positioned at the middle of the sides. Screws received with screw holes 28, 28*a* facilitate clamping action of the access cover 24 for a watertight seal when a sealant is placed between the upper edge 20*f* of the interface housing 20 and top access cover 24. Mounting flanges 30 can be positioned at each lower side edge of the interface housing 20 to allow mounting of the interface housing onto a bilge bulkhead 18 or other floor or wall surface using screws or other attachment mechanisms known to those skilled in the art.

A mounting board 32 is formed as a circuit board and positioned in a medial portion of the bottom wall surface 20*e*. Wire connectors 34 are mounted on the mounting board 32 and formed as screw-down type wire connectors into which a stripped wire end is inserted. A user turns the screw 36 to hold the wire therein. These wire connectors 34 are formed of brass or other similar material and resist corrosion, even though they are contained within a watertight interface housing structure. The wire connectors 34 can be held to the board by solder, screws 38 (as illustrated), or a combination of both. Solder 40 can be used to aid in interconnecting opposed connectors as illustrated.

separate pump wire connector 34*a* and float switch wire connector 34*b* are associated with a single manual wire connector 34*c* as shown in FIG. 3. A single automatic wire connector 34*d* (for automatic pump operation) is associated with a single float switch wire connector 34*e*. A single common wire connector 34*f* (for ground connection) is associated with a single pump wire connector 34*g*, as illustrated. The cut power source wires 41 (FIG. 1) connect to the manual, automatic, and common wire connectors 34*c*, 34*d* and 34*f* that are positioned opposite the respective pump and float switch wire connectors to which the bilge pump and float switch wires are connected. At least one wire access opening or port as sometimes referred 42 is positioned on either side of the interface housing to route the appropriate wires as a group to the respective wire connectors 34. As illustrated, because there are four separate pump and float switch wire connectors, four access ports 42 are provided to permit straight-end wire access to the respective wire connectors 34. On the opposite side, where three separate wire connectors 34 (manual, automatic and common) are located, three access ports 42 are provided.

The method of the present invention is illustrated in the high level flow chart shown in FIG. 5. The method of the present invention facilitates operation and replacement of a bilge pump 12 and float switch 14 located in the bilge 16 of a boat and powered by a boat power source 10 and having a manual and automatic mode of operation. In the non-limiting example of the present invention, the power source, bilge pump and float switch wires located between the boat power source and bilge pump and float switch are first cut (Block 100). The bilge pump and float switch are removed (Block 102). The bilge pump and float switch are replaced with a new pump onto the existing pump and switch mounting locations (Block 104). At the same time, the interface housing having the access cover removed is secured onto the bilge bulkhead by screws or other attachment mechanisms (Block 106). The power source wires are routed through the appropriate access ports into the interface housing and the bilge pump and float switch wires are routed through the access ports on the opposing side (Block 108). The wires are manually inserted into respective screw-down type wire connectors via the access opening and tightened by turning the screws (Block 110). A sealer for moisture protection is sprayed onto the wire connectors after the wires are connected thereto (Block 112). The wire access ports are sealed with a watertight seal (Block 112). The access cover is replaced over the access opening in a watertight seal (Block 114). The operation of the bilge pump and associated float switch are tested (Block 116).

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A method of facilitating operation and replacement of a bilge pump and float switch located in the bilge of a boat and powered by a boat-power source and having a manual and automatic mode of operation, comprising the steps of:

cutting the power source, bilge pump and float switch wires located between the boat power source, bilge pump and float switch;

replacing the bilge pump and float switch; and routing power source wires into an interface housing and connecting the power source wires to separate manual, automatic and common wire connectors mounted therein while also routing bilge pump and float switch wires into the interface housing and connecting the bilge pump and float switch wires to separate pump and float switch wire connectors mounted therein.

2. A method according to claim 1, and further comprising the steps of associating a separate pump wire connector and float switch wire connector with a single manual wire connector, associating a single automatic wire connector with a single float switch wire connector, and associating a single common wire connector with a single pump wire connector.

3. A method according to claim 1, and further comprising the step of sealing the interface housing in a watertight seal after connecting the various wires to various wire connectors.

4. A method according to claim 1, and further comprising the step of forming the separate manual, automatic and common wire connectors in opposed relation to the respective pump and float switch wire connectors to facilitate connection of the respective power, bilge, pump and float switch wires.

5. A method according to claim 1, and further comprising the step of inserting the wires into screw down connectors to facilitate connection thereto.

6. A method according to claim 1, and further comprising the step of routing the power source wires through an at least one access port on one side of the interface housing and routing the bilge pump and float switch wires through an at least one opposed access port on the other side of the interface housing.

7. A method according to claim 1, and further comprising the step of forming the interface housing to have a top access opening through which wires can be manually manipulated into various wire connectors and onto which an access cover is positioned to form a watertight interface housing.

8. A method of facilitating operation and replacement of a bilge pump and float switch located in the bilge of a boat and powered by a boat power source and having a manual and automatic mode of operation, comprising the steps of:

cutting the power source, bilge pump and float switch wires located between the boat power source, bilge pump and float switch;

replacing the bilge pump and float switch onto existing mounting locations while also securing onto the bilge bulkhead a interface housing having at least one wire access port, an access cover and access opening, separate manual, automatic and common wire connectors and respective separate pump and float switch wire connectors;

routing power source wires through the at least one wire access port into the interface housing and connecting the power source wires to the manual, automatic and common wire connectors while also routing bilge pump and float switch wires through the at least one wire access port into the interface housing and connecting the bilge pump and float switch wires to respective pump and float switch wire connectors by manually manipulating the wires and wire connectors via the access opening;

sealing the at least one wire access port with a watertight seal;

replacing the access cover over the access opening in a watertight seal; and testing operation of the bilge pump and associated float switch.

9. A method according to claim 8, and further comprising the steps of associating a separate pump wire connector and float switch wire connector with a single manual wire connector, associating a single automatic wire connector with a single float switch wire connector, and associating a single common wire connector with a single pump wire connector.

10. A method according to claim 8, and further comprising the step of spraying the respective manual, automatic, common, pump and float switch wire connectors with a sealer for moisture protection after the power source wires and bilge pump and float switch wires are connected thereto, but before placing the access cover over the access opening.

11. A method according to claim 8, and further comprising the step of sealing the at least one wire access port with a silicon sealer.

12. A method according to claim 8, and further comprising the step of routing the power source wires through at least one access port and routing the bilge pump and float switch wires through another at least one access port for maintaining separate wire groups and facilitating speed in replacement of a bilge pump and float switch.

13. A method according to claim 8, and further comprising the step of forming the interface housing as a substantially rectangular configured housing having the respective manual, automatic, and common wire connectors along one side and respective pump and float switch wire connectors along the other side to facilitate wire access.

14. A method according to claim 8, and further comprising the step of forming the respective wire connectors as screw down connectors into which a wire end is inserted and turning a screw to hold down the wire therein.

* * * * *